US007635401B2

(12) United States Patent
Dietz

(10) Patent No.: US 7,635,401 B2
(45) Date of Patent: Dec. 22, 2009

(54) ADJUSTABLE AIR FLOW VENTILATION DEVICE AND SYSTEM

(76) Inventor: Dan L. Dietz, 10234 Emerald Dr., Houston, TX (US) 77074

( * ) Notice: Subject to any disclaimer, the term of this patent is extended or adjusted under 35 U.S.C. 154(b) by 193 days.

(21) Appl. No.: 11/400,535

(22) Filed: Apr. 6, 2006

(65) Prior Publication Data

US 2007/0234689 A1 Oct. 11, 2007

(51) Int. Cl.
*A01K 1/03* (2006.01)

(52) U.S. Cl. ..... 55/385.1; 55/481; 55/486; 55/487; 55/472; 55/473; 55/467; 55/493; 55/506; 119/418; 119/419; 119/420; 119/448; 119/500; 232/43.1; 232/43.4

(58) Field of Classification Search ..... 55/481, 55/385.1, 385.6, 486, 487, 472, 473, 467, 55/506, 493; 454/187; 119/418, 419, 420, 119/448, 500; 232/43.1, 43.4
See application file for complete search history.

(56) References Cited

U.S. PATENT DOCUMENTS 5,809,936 A * 9/1998 Wall ..... 119/484
6,997,138 B1 2/2006 Simpson
7,112,232 B2 * 9/2006 Chang et al. ..... 55/481
2005/0097870 A1 * 5/2005 Moshenrose ..... 55/385.1
2006/0042205 A1 * 3/2006 Kalous et al. ..... 55/385.1

* cited by examiner

*Primary Examiner*—Robert A Hopkins
*Assistant Examiner*—Minh-Chau T Pham
(74) *Attorney, Agent, or Firm*—Daniel N. Lundeen; Lundeen & Lundeen PLLC

(57) ABSTRACT

This system provides an air-ventilating and cleaning element positioned within a housing. The housing contains multiple vents in the housing walls. The vents serve as channels that enable air to flow into and out of the air-ventilating device. The air-ventilating and cleaning element can vary and can range from a simple air ventilator to and an air purifier. The cleaning element can contain a filter element to further facilitate cleaning of the air. The cleaning element can be positioned in the housing on a track or pin to allow for movement of the cleaning element within the housing. Movement of the cleaning element may be desired in order to more efficiently clean air channeled through the device. Because of the ability to move the cleaning element, air flow through the device can be adjusted depending on a particular cleaning application.

16 Claims, 6 Drawing Sheets

ADJUSTABLE AIR FLOW VENTILATION DEVICE AND SYSTEM

FIELD OF THE INVENTION

This invention relates to a device and system for ventilating an area and removing undesirable and unhealthy bacteria and other particles from the air and in particular this invention relates to an air ventilation device and system in which the direction of the flow of air through the device or system can be adjusted. More particularly, this invention relates to an air ventilation device and system for use with animal containers to reduce the order particles that accumulate in the vicinity of the animal container as the result of an animal residing in the container.

BACKGROUND OF THE INVENTION

An air purifier is a device which aims to free air from contaminants. The popularity of air purifiers spur from the results from environment researches which claim that the air inside homes are dirtier than the air outside of homes. Air purifiers are particularly beneficial for allergy sufferers and asthmatics or those who wish to reduce second-hand smoke. Allergy-inducing culprits are known as allegens. Allergens can come in the form of dust or pollen as well as pet dander and mold spores. Hazardous smoke particles and airborne gases may also find their way into homes and bedrooms. Because of the significant amount of time most people spend indoors, many wish to ensure air purity.

Various techniques are used in air purifiers in the current market to accomplish indoor air purification. These techniques include mechanical filters, absorbents such as charcoal, and electrostatic charges or ionizers. The most popular sort of filters for air purifiers is the HEPA filter. The Department of Energy has rigid requirements manufacturers must pass to meet HEPA requirements. Additional setups include germicidal UV light and the emission of ions into the air to react with contaminants and making them harmless enough to breathe. Although air purifiers strive to make the air as clean as possible, no commercial air purifier is capable of producing a room as clean as needed in situations requiring an especially clean environment, such as hospital surgical rooms or sensitive manufacturing like optics or computer processors.

In addition to the general contaminants that are in the air, owners of pets also live with the contaminants that come from the animals. Millions of households keep domesticated pets indoors. Allowing the animal to remain indoors reduces exposure to infectious diseases, territorial disputes with other neighborhood animals, and exposure to the harsher elements of weather, such as rain, snow, the cold of winter and the heat of summer. Although many pet owners keep their pets indoors, a shortcoming of current pet enclosures is that they absorb and emit pet odors that can foul the smell of the entire house or apartment surroundings. For example, the inclusion of many materials such as wood and/or other natural materials, and/or natural or synthetic fabric into an enclosure can trap urine and other sources of unpleasant odors associated with animals. Attempts to reduce the absorption of odors have generally focused on fabricating the structure entirely of metal or other non-porous materials. These odors contribute to the contamination that is generally in the air as previously described.

One attempt to reduce pet odor is described in U.S. Pat. No. 6,997,138. This patent describes a pet enclosure having a moisture and odor-resistant, plastic, rattan-like material woven onto a frame. Although this odor-resistant plastic does reduce some of the odor coming from the animals, a substantial amount of pet odor remains in the air.

There remains a need for an improved and flexible air ventilation system that can be adapted to remove contaminants and animal odors from the air.

SUMMARY OF THE INVENTION

It is an objective of the present invention to provide an air ventilation device and system in which the flow of air through the device or system can be adjusted.

It is a second objective of the present invention to provide a rotatable cleaning element contained in the air-ventilating device.

It is a third objective of the present invention to provide an air-ventilating system in which air is drawn directly from an animal container thereby reducing the amount of animal odor accumulating in the animal container.

It is a fourth objective of the present invention to provide air ventilating device that can be housed in a variety of containers to facilitate the application of the device in different configurations.

It is a fifth objective of the present invention to provide an air cleaning system that can be incorporated into various cabinet type structures.

The present invention is an air-ventilating device and system. This system comprises an air-ventilating and cleaning element positioned within a housing. The housing contains multiple vents in the housing walls. The vents serve as channels that enable air to flow into and out of the air-ventilating device. The air-ventilating device and cleaning element can vary and can range from a simple air ventilator to and an air purifier. The cleaning element can contain a filter element to further facilitate cleaning of the air. The cleaning element can be positioned in the housing on a track or pin to allow for movement of the cleaning element within the housing. Movement of the cleaning element may be desired in order to more efficiently clean air channeled through the device. Because of the ability to move the cleaning element, airflow through the device can be adjusted depending on a particular cleaning application. The cleaning element can also be mounted to a wall of the housing.

DETAILED DESCRIPTION OF THE INVENTION

Figure 1:
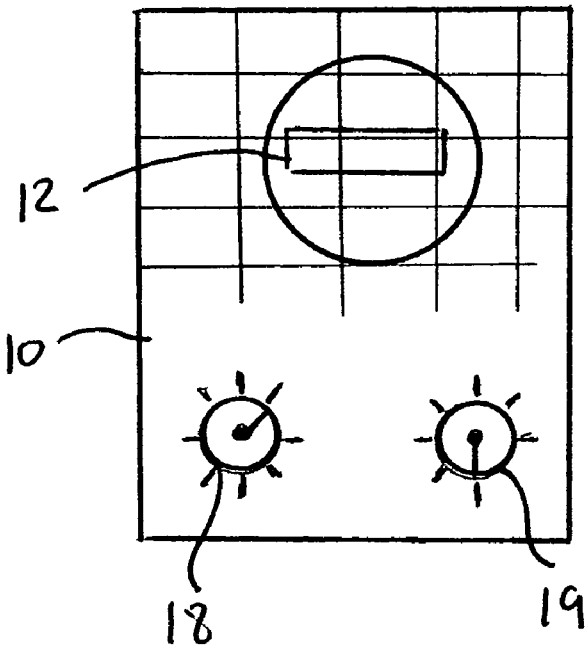
FIG. 1 is a front view of a conventional air-cleaning device.
Figure 2:
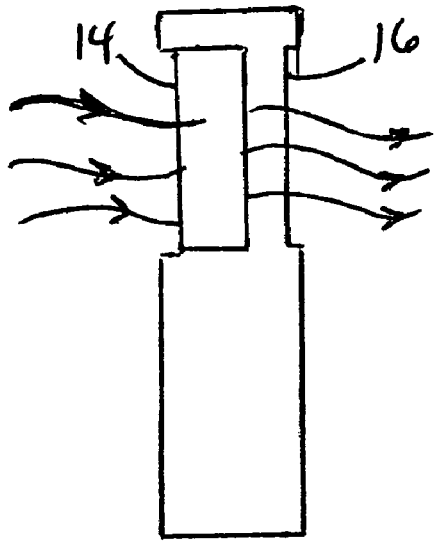
FIG. 2 is a side view of a conventional air-cleaning device.
Figure 3:
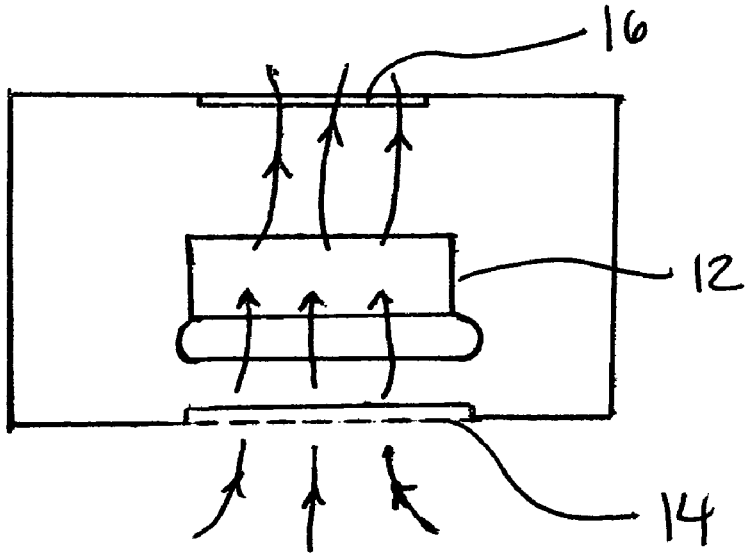
FIG. 3 is a view of the components of a conventional air cleaning device and the general direction of airflow through that device.

FIGS. 1, 2 and 3 illustrate a typical configuration of an air ventilating and purifying system. As shown, the device 10 contains a cleaning element 12 within the device. This cleaning element varies and will depend on the type of purifying technique that is used in the device. As previously mentioned, these purifying techniques include mechanical filters, absorbents such as charcoal, and electrostatic charges or ionizers. Referring to FIG. 2, vents 14 and 16 provide a channel to allow air to flow into and through the air-cleaning device. Dials 18 and 19 can control the amount of the through the cleaning device.

FIG. 3 shows the flow of the air through the system. As shown, air can enter into the air cleaner through vent 14. At this point, the air is drawn into the cleaning element. Regardless of the cleaning technique employed, contaminants in the air are removed in the cleaning element. Once cleaned, the air flows out of the cleaning device through vent 16.

Figure 4:
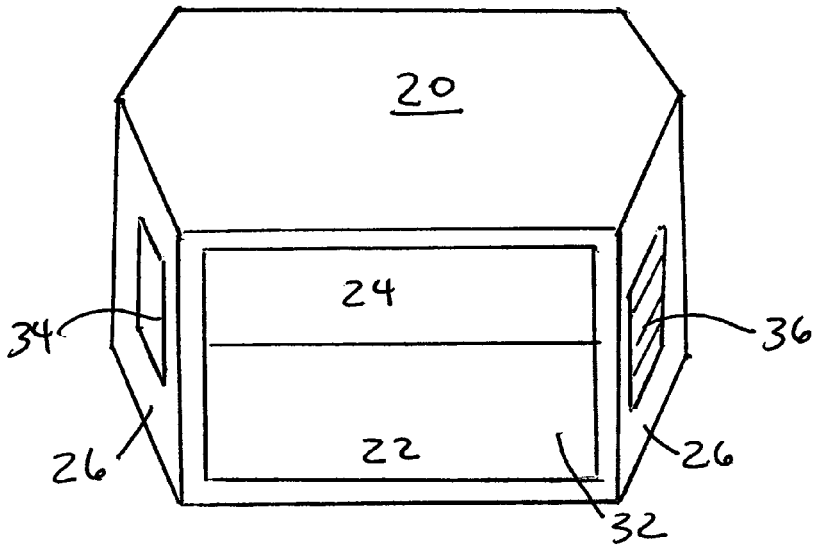
FIG. 4 is a front, top and side view of an animal container which the air cleaning device of the present invention can be used to remove animal odor.

FIG. 4 shows a general design of the multiple function animal piece that can be used as part of the air ventilation system of the present invention. This configuration is further described in U.S. patent application Ser. No. 11/344,655 and U.S. patent application Ser. No. 11/121,797 to the same inventor. As shown, this piece has a top 20, open front side 22, a backside 24 (not shown in FIG. 4), multiple side walls 26 and 28. The number of side will vary with the particular design shape. This furniture piece can also contain a floor. The front side 22 has an opening 32, which covers a large portion of the front side. This large opening allows for animals to easily enter the furniture piece. The opening also allows for easy insertion of toys and food and water trays into the furniture piece. In addition, small vent openings 34 and 36 can be included the side walls. These opening improve ventilation in the furniture piece. The front side also has a lip 38 that extends up from the base.

Figure 5:
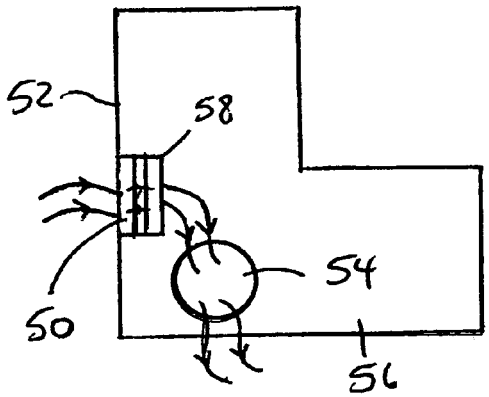
FIG. 5 is a side view of a stair-step configuration of the air ventilation device of the present invention.

FIG. 5 shows a side view of a configuration of an air-cleaning device of the present invention. In this configuration, the air cleaner housing is a stair-step device. In this configuration, one air vent 50 is positioned in the back wall 52 of the housing. A side vent 54 is positioned in the side wall 56 of the housing. A second side vent, not shown, is also positioned in the side wall opposite side wall 56. These two side vents are symmetrical. Air flows through the air vent 50 and into the air-cleaning device. The air then flows through the cleaning element 58. The air cleaning element can be one such as those manufactured by Natural Air (model number Natural Air 50) the cleaned air then flows from the cleaning element and out of the air-cleaner through vents 54 in the side wall. This housing is suited to be positioned adjacent an animal container such as the one described in FIG. 4.

Figure 6:
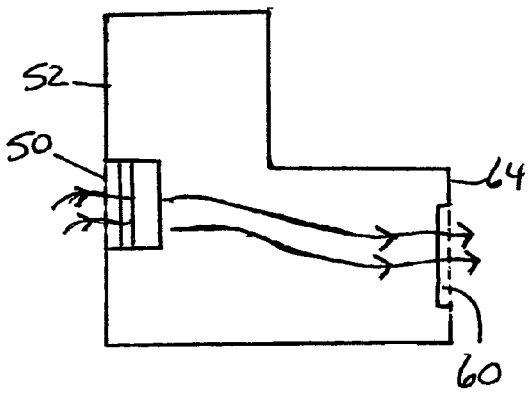
FIG. 6 is a side view of an alternate embodiment stair-step configuration of the air ventilation device of the present invention.

FIG. 6 shows a side view of an alternate stair-step configuration of an air-cleaning device. In this configuration, vent 50 is still in the back wall 52. However, the second vent 60 is at the front 64 of the stair-step housing. In this embodiment, the air flows from the cleaning element 58 and out of the air cleaning device through vent 60.

Figure 7:
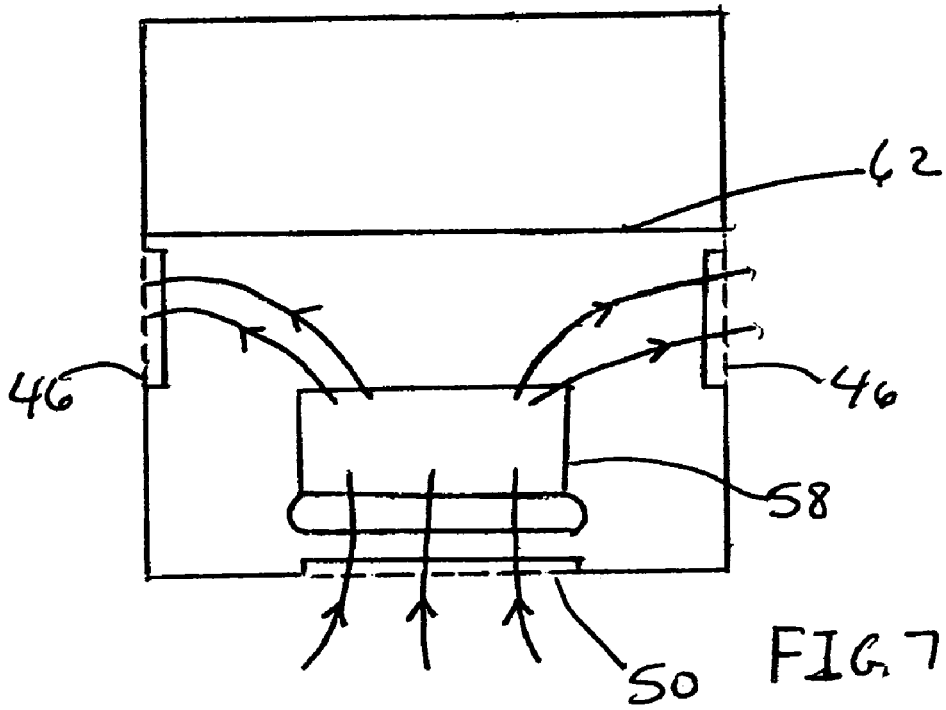
FIG. 7 is a view of the air through the air ventilation device configuration of FIG. 5.

FIG. 7 shows the air flow pattern of the configuration illustrated in FIG. 5. As previously described, flows through vent 50 and the cleaning element 58. Air then flows out the cleaning device through vents 46 in the side walls. This configuration can also have a wall 62 to helps facilitate the flow of air through the side vents.

Figure 8:
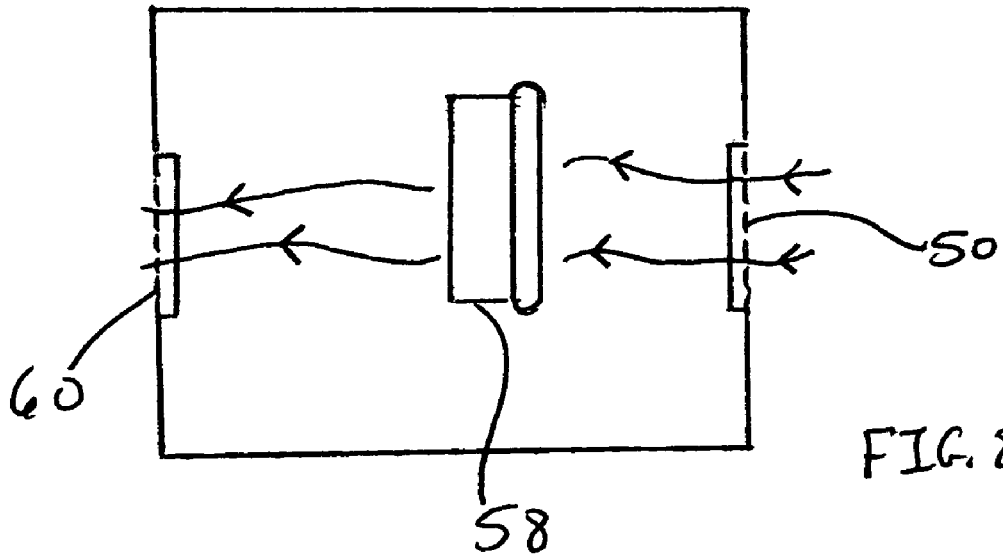
FIG. 8 is a view of the air through the air ventilation device configuration of FIG. 6.

FIG. 8 shows the flow air through the configuration illustrated in FIG. 6. Air is drawn into the cleaning device through vent 50. The air then travels through the air cleaning element 58 and out of the air cleaning device through vent 60.

Figure 9A:
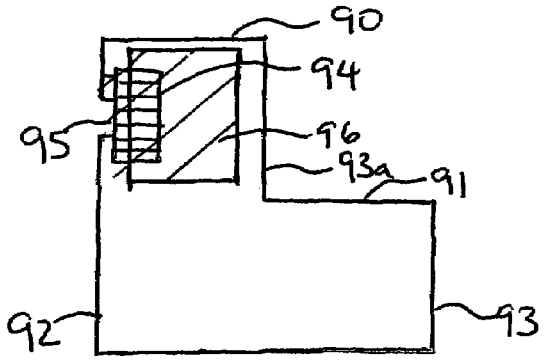
FIG. 9*a* is a side view of an alternate stair-step configuration of the air ventilation device of the present invention.
Figure 9B:
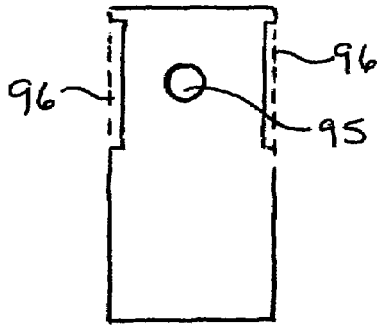
FIG. 9*b* is a cross-section view of the backside of the alternate stair-step configuration of the air ventilation device shown in FIG. 9*a*.

FIG. 9*a* shows an alternate embodiment of the air ventilating system of the present invention. This embodiment is another stair-step design. Shown are two steps 90 and 91 with a front side 92 and a back side 93. An opening 95 in the upper section of the back side provides an inlet through which air will flow into the device. The cleaning element 94 is attached to the back side 92 and is positioned such that it can draw air through the opening 95 into the housing. Openings 96 are on each side of the housing. FIG. 9*b* shows a cross-section view of the back side of the housing. Shown are the opening 95 and side openings 96.

Figure 10A:
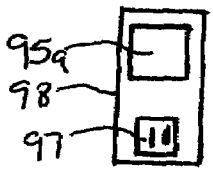
FIG. 10*a* is a front view of a plug element positioned within the air-ventilating device.
Figure 10B:
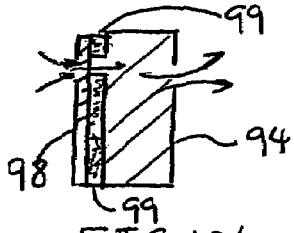
FIG. 10*b* is a front view of a plug element positioned within the air-ventilating device.

FIG. 10*a* shows a plug element. This plug element 98 can be positioned on the inside of the back wall 92 and positioned such that the wall opening 95 is aligned with opening 95*a* in the plug element. An electrical plug 97 provides a means to supply power to the air cleaning element 94. FIG. 10*b* shows a side cross-section view of the plug element attached to the air cleaning element. A gasket material 99 can be positioned between the plug element 98 and the air cleaning element 94 to form a seal between the air cleaning element and the plug element.

Figure 11A:
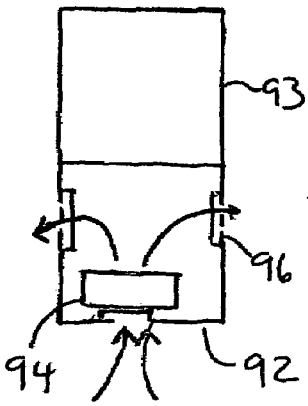
FIG. 11*a* is a top view of the air-ventilating device and configuration shown in FIG. 9*a*.
Figure 11B:
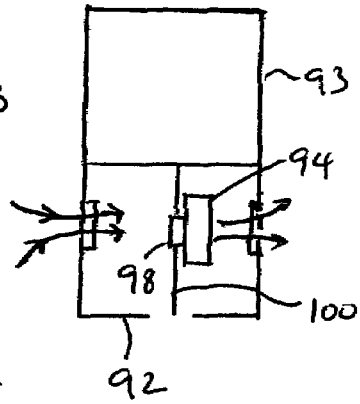
FIG. 11*b* is a top view of the air-ventilating device and configuration shown in FIG. 9*a* oriented to draw through one-side of the housing.
Figure 11C:
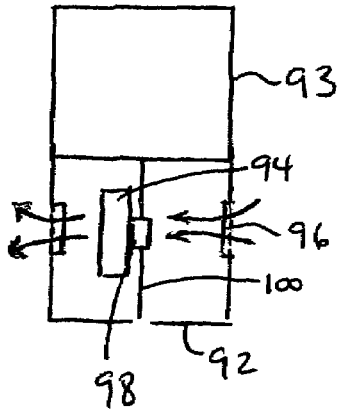
FIG. 11*c* is a top view of the air-ventilating device and configuration shown in FIG. 9*a* oriented to draw through the side opposite the side shown in FIG. 11*b* of the housing.

FIGS. 11*a*, 11*b* and 11*c* show different configurations of the air cleaning device. In these configurations 11*b* and 11*c*, a wall 100 is constructed to enable the flow of air between side openings as previously shown in FIG. 8. The wall 100 contains the plug element 98. The air cleaning element can be positioned on either side of the wall depending on which direction is flow is desired. In FIGS. 11*b* and 11*c*, the air will flow into the air cleaning unit through one opening, through the air cleaning element and out through the other side opening.

Figure 12:
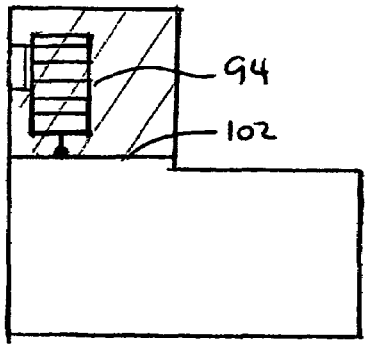
FIG. 12 is an alternate embodiment of the air-ventilating device shown in FIG. 9*a* with the air-cleaning element attached to a track for linear and circular movement of the cleaning element.

FIG. 12 shows a side view of the air cleaning element on a track in the housing to facilitate linear and circular movement of the air cleaning element in the housing. This configuration provides for movement of the air cleaning element to direct air flow through the housing as desired.

Figure 13A:
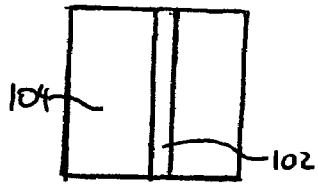
FIGS. 13*a* and 13*b* show a top view of various embodiments of the track for moving the cleaning element.
Figure 13B:
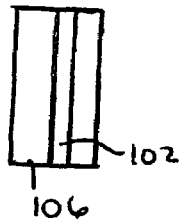
Figure 14:
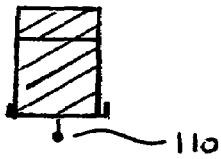
FIG. 14 is a side view of the air-cleaning element attached to a pivot pin/ball for movement of the air-cleaning element.
Figure 15:
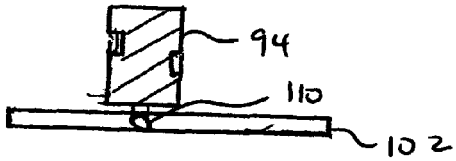
FIG. 15 shows a side view of the air-cleaning element attached to the track.

FIGS. 13*a* and 13*b* show different configurations of the track 102. A complete floor 104 can be positioned in the housing to support the track. In the alternative, FIG. 13*b* shows a partial floor 106 to support the track 102. FIGS. 14 and 15 show the air cleaning element attached to the housing. The pin 110 that engages the track allows for linear and circular movement of the air cleaning element within the housing.

In another application, it may be desirable or necessary for the cleaning device to be positioned such that air flows in through the side of the device instead of the back as previously described. For this application, it may be necessary to change the orientation of the cleaning element such that it faces the side vent. The orientation of the cleaning element could be changed using a dial on the external surface of the housing. This dial would be connected to a control mechanism that is connected to the cleaning element. For example, to rotate the cleaning element in a clockwise direction, the user could turn the dial in a clockwise direction until the desired orientation of the cleaning element is obtained. For maximum efficiency, it is better to have the best alignment of the cleaning element with the vent through which air will be drawn into the cleaning device.

The various orientations of the cleaning element can be in a circular direction or they can be combination of circular and linear directions. To facilitate this combination of linear and circular orientations, the cleaning element could have pins on the top and bottom. The top pin could be in mechanical communication with an external control dial. The bottom pin could be positioned in a linear track. The attachment of the pin with the track could be in a manner such the user could move the cleaning element in a linear direction and could also rotate the cleaning element while moving it in a vertical direction.

Figure 16:
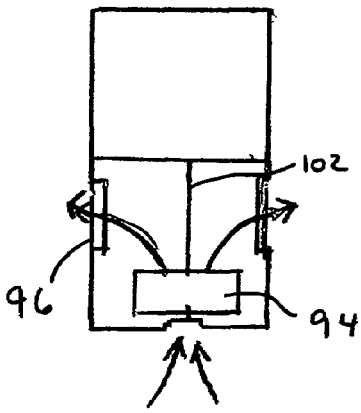
FIGS. 16, 17 and 18 are top views the air-ventilating device and configuration with the cleaning element attached to the track and orientated at different positions within the housing.
Figure 17:
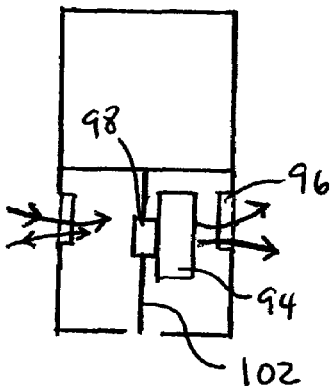
Figure 18:
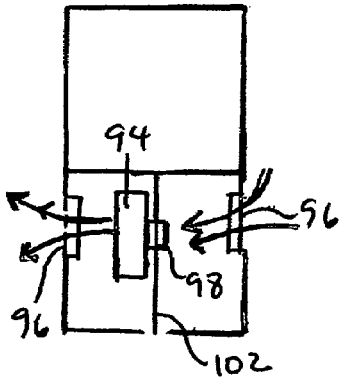

FIGS. 16, 17 and 18 show various configurations of the air cleaning element on the track. FIG. 16 shows a configuration in which the air cleaning is drawing air into the housing in the back side of the housing as illustrated in FIG. 9*a*. In FIG. 17, the air cleaning element can be moved linearly and rotated circularly such that is draws air into through a side opening and out of the housing through the opposite side opening. FIG. 18 is an orientation of the air cleaning element such that it draws air into the housing through the side opening that is opposite the side opening shown in FIG. 17. In each mentioned embodiment, the air travels through the air cleaning element before existing the housing.

Figure 19:
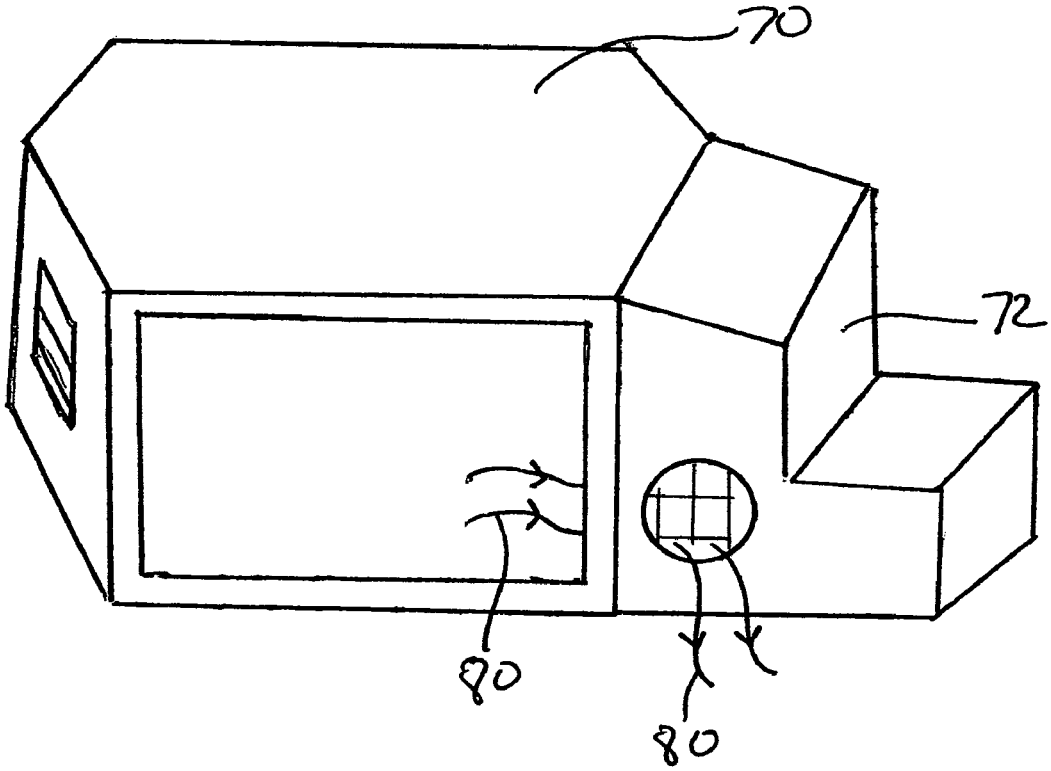
FIG. 19 is a view of an air ventilation system of the present invention incorporating a stair-step air ventilating device and a vented animal house container.

FIG. 19 shows an embodiment of the system of the present invention. This system comprises an air cleaning device similar to one shown in FIG. 5, in combination with an animal containing device. This animal containing device is similar to the one shown in FIG. 4. The animal container 70 is positioned adjacent the air-cleaning device 72 so that the stairs of the air-cleaning device lead to a top of the container70. The air-cleaning device is positioned such that the back wall 52 under the top step of the device (see FIG. 5) covers the vent in one side of the animal container. The positioning of the air-cleaning device should be such that the vent 36 of the animal container is aligned with the vent 50 of the air cleaning device (see FIG. 5). As shown, this configuration of the air-cleaning device has the vents in the side walls. The air inside the animal container space is contaminated with the smell of the animal. As mentioned, this smell filters into the entire room. With the present invention, the air 80 from the container is drawn out of the container 70 through the side vent 36 and back vent 50 and into the air cleaning device 72. When in the air cleaner, the cleaning element cleans the air. The air 80 then flows out of the cleaning device through the side vents that are spaced away from the container 70.

The system of the present invention can also comprise a configuration in which the structures as shown in FIG. 19 are combined as one structure having multiple sections.

The structures described in this invention can be constructed from any conventional building material such as metal, wood or plastic.

As mentioned, the configurations for configuring the air cleaning device and system will vary. Described herein are only examples of various configurations and various air cleaning and purifying techniques. These air cleaning techniques are conventional techniques that are implemented in this invention. The invention described herein is not limited in scope to the example configurations described in this disclosure.

The present invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. An air cleaning device for an animal container having a vent opening in a wall, comprising:

a housing having at least one wall with external and internal surfaces, said housing having a stair-step configuration, said wall having at least two openings therein, said openings being positioned at different locations in the wall such that the openings have different orientations to each other, wherein said housing can be positioned adjacent the animal container to align the vent opening of the animal container with one of said openings in said housing wherein another one of said openings in said housing is spaced away from said animal container; and an air cleaning element positioned within the housing, said air cleaning element having the capability to draw air into the housing from the animal container through the aligned openings, said air cleaning element being affixed to the wall of said housing.

2. The device as described in claim 1 further comprising at least two parallel side walls with one opening being positioned in each of said walls to allow air to flow into and out of the device.

3. The device as described in claim 2 further comprising a back wall under a top step, wherein the back wall comprises an opening; the back wall being perpendicular to the side walls and said back wall being attached to one end of each of said side walls.

4. The device as described in claim 3 wherein air is drawn into the cleaning device through the opening in said back wall and air exits the device through openings in said side walls.

5. The device as described in 1 further comprising a plug element positioned within said housing, said plug element having an opening aligned with an opening in the wall of said housing, said plug also capable of facilitating the supply of power to the air cleaning element.

6. The device as described in claim 5 further comprising a material positioned between the plug element and the air cleaning element to function as seal to prevent the escape of air as air flows through the plug and air cleaning element.

7. The device as described in claim 2 wherein the air cleaning element is positioned to draw air from one of the side wall openings and discharge cleaned air through the other side wall opening.

8. The device of claim 7 wherein a plug element can be attached to the wall and positioned such that an opening in the plug is aligned with the opening in the wall to allow air flow through the housing.

9. The device as described in claim 8 wherein the air cleaning element can be positioned on either side of the housing to draw air into and through the housing through one side opening, the air cleaner and exit the housing through the other side opening as desired.

10. An air cleaning system comprising:

a housing having a stair-step configuration and at least one wall below the steps with external and internal surfaces, said wall having at least two openings therein, said openings being positioned at different locations in the wall such that the openings have orientations to each other;

an air cleaning element positioned within the housing, said air cleaning element having the capability to draw air into the housing through one of the openings, said air cleaning element being affixed to an internal surface; and a container structure having at least one wall with one opening therein such that the housing can be positioned adjacent this container structure in a manner that at least one of the openings in the container structure is aligned with the at least one opening in the wall of the housing, to allow air flow from the container structure, into the housing, through the air cleaning element and out of the housing through the at least one other opening.

11. The system as described in claim 10 wherein said housing and said container structure share a common wall such that the housing and container structure comprise a single structure.

12. The system as described in claim 10 wherein the housing comprises a floor, said air cleaning element being affixed to an internal surface of a floor of said housing such that the air cleaning element can be moved and orientated on the floor.

13. The device as described in claim 12 further comprising one or more pin elements attached to said air cleaning element to facilitate movement of said air cleaning element inside said housing.

14. The device as described in claim 13 further comprising a track in the floor of said housing for engaging said pin to facilitate reorientation of the cleaning element.

15. The device as described in claim 14 wherein the reorientation can be linear, circular or a combination of linear and circular orientations.

16. An air ventilation system, comprising:

a multiple function animal piece comprising a top, an open front side for animal entry, a back side, a plurality of side walls and vent openings formed in the side walls;

a stair-step device comprising a back wall depending from a top step and opposing side walls extending under the steps from the back wall to a front wall depending from a lower step, wherein the back wall is disposed adjacent one of the side walls of the animal piece to cover one of the vent openings, wherein the steps lead up to the top surface;

an air inlet formed in the back wall and aligned with the covered vent opening;

at least one air vent formed in the opposing side walls; and an air cleaning element positioned within the stair-step device to draw air from the animal piece and discharge cleaned air toward the at least one vent in the opposing side walls.

* * * * *